US010300495B2

(12) United States Patent
Galvin

(10) Patent No.: US 10,300,495 B2
(45) Date of Patent: May 28, 2019

(54) APPARATUS AND METHOD FOR REMOVING AN UNDERFLOW STREAM

(71) Applicant: NEWCASTLE INNOVATION LIMITED, Callaghan, New South Wales (AU)

(72) Inventor: Kevin Patrick Galvin, Callaghan (AU)

(73) Assignee: NEWCASTLE INNOVATION LIMITED, Callaghan (AU)

( * ) Notice: Subject to any disclaimer, the term of this patent is extended or adjusted under 35 U.S.C. 154(b) by 0 days.

(21) Appl. No.: 15/502,106

(22) PCT Filed: Jul. 29, 2015

(86) PCT No.: PCT/AU2015/000453

§ 371 (c)(1),
(2) Date: Feb. 6, 2017

(87) PCT Pub. No.: WO2016/019411

PCT Pub. Date: Feb. 11, 2016

(65) Prior Publication Data

US 2017/0225175 A1 Aug. 10, 2017

(30) Foreign Application Priority Data

Aug. 6, 2014 (AU) ..... 2014903049

(51) Int. Cl.
*B03B 5/62* (2006.01)
*B03B 11/00* (2006.01)
*B03B 13/00* (2006.01)

(52) U.S. Cl.
CPC ..... *B03B 11/00* (2013.01); *B03B 5/623* (2013.01); *B03B 13/00* (2013.01)

(58) Field of Classification Search
CPC .. B03B 5/62; B03B 5/623; B03B 5/66; B03B 11/00; B03B 13/005
See application file for complete search history.

(56) References Cited

U.S. PATENT DOCUMENTS 934,611 A * 9/1909 Hitchcock ..... B03B 5/623 209/160
2,297,311 A 9/1942 Mead et al.
(Continued)

FOREIGN PATENT DOCUMENTS

CN 1974021 A 6/2007
CN 101543802 A 9/2009

OTHER PUBLICATIONS

International Search Report for PCT/AU2015/000453, dated Nov. 17, 2015.

(Continued)

*Primary Examiner* — Joseph C Rodriguez
(74) *Attorney, Agent, or Firm* — Marshall, Gerstein & Borun LLP

(57) ABSTRACT

An apparatus and method for removing an underflow stream is provided suitable for removing an underflow stream from a separator, such as a mineral particle separator. In one aspect, the separator can include a discharge outlet for discharging the underflow stream, and the apparatus can include a source of pressurised fluid, a first conduit for fluidly connecting the pressurised fluid source to the discharge outlet such that the pressurized fluid is directed to impede the flow of the underflow stream in the first conduit, thereby creating a fluidisation zone, and a second conduit fluidly connected to the first conduit so that material from the fluidisation zone flows into the second conduit for removal from the apparatus.

22 Claims, 2 Drawing Sheets

(56) References Cited

U.S. PATENT DOCUMENTS

| | | | | | |
|---|---|---|---|---|---|
| 2,960,226 | A * | 11/1960 | Ekstrom, Jr. | B03B 5/623 | 209/158 |
| 3,412,858 | A * | 11/1968 | Stone | B03B 5/60 | 209/159 |
| 3,446,352 | A * | 5/1969 | Sahores | B03B 5/623 | 209/161 |
| 3,700,102 | A * | 10/1972 | Higgins | B03B 5/66 | 209/158 |
| 4,033,863 | A * | 7/1977 | Stone | B03B 5/66 | 209/159 |
| 4,388,182 | A * | 6/1983 | Hudson | B03B 5/66 | 209/158 |
| 4,533,464 | A * | 8/1985 | Smith | B03B 5/66 | 209/158 |
| 4,784,757 | A * | 11/1988 | Nelson | B03B 5/623 | 209/159 |
| 5,692,620 | A * | 12/1997 | Christensen | B03B 5/623 | 209/461 |
| 5,944,196 | A * | 8/1999 | Oram | B03B 5/623 | 209/158 |
| 7,380,669 | B2 * | 6/2008 | Hacking, Jr. | B01F 3/188 | 209/10 |
| 2006/0081503 | A1 * | 4/2006 | Wegner | B03B 5/32 | 209/17 |
| 2010/0193408 | A1 * | 8/2010 | Jameson | B03D 1/24 | 209/164 |

OTHER PUBLICATIONS

Written Opinion for PCT/AU2015/000453, dated Nov. 17, 2015.
Office Action issued in Chinese Patent Application No. 2015800422612, dated Jul. 16, 2018.

* cited by examiner

APPARATUS AND METHOD FOR REMOVING AN UNDERFLOW STREAM

FIELD OF THE INVENTION

The invention relates to an apparatus and method for removing an underflow stream and in particular to an apparatus and method for removing an underflow stream from a separator. The invention has been developed primarily for use with a mineral particle separator and will be described hereinafter by reference to this application.

BACKGROUND OF THE INVENTION

The following discussion of the prior art is intended to present the invention in an appropriate technical context and allow its advantages to be properly appreciated. Unless clearly indicated to the contrary, however, reference to any prior art in this specification should not be construed as an express or implied admission that such art is widely known or forms part of common general knowledge in the field.

The discharge of slurry as an underflow stream from below a separator is not easy to control. The slurry normally contains particles less than 1 mm, but could equally contain larger particles, or a very small portion of these larger particles. The separator typically has a valve that can be partially opened to regulate the slurry discharge. Thus, as the valve is gradually opened there is a very significant increase in the discharge rate of the slurry. This rapid discharge arises because the slurry in the separator, located above the valve, delivers a significant hydrostatic head, whereas the opening created by the valve is exposed to atmospheric pressure. The pressure driving force of the discharge slurry is therefore significant.

It is standard practice to apply a PID control strategy to regulate this discharge according to some objective. In separators like a reflux classifier or a teetered bed separator the lower zone of the vessel is fluidised via an upward current fluidising flow. This results in a suspension density bed profile, which can be measured using pressure transducers. Usually two pressure transducers are located at two elevations or heights of the separator, thus providing the average suspension density in the zone between those elevations. The separator is then operated by controlling the underflow discharge in order to target a specific suspension density set point. This approach tends to deliver a corresponding underflow yield and underflow grade.

There are many kinds of valves that are used with these types of separators. However, it is common for the valve opening to vary non-linearly, while the discharge rate varies considerably. In addition, the coarser particles can easily bridge the gap of the opening, limiting discharge out of the valve opening, thus causing the controller to seek an even larger opening by further opening the valve. Once this bridging breaks, the rate of discharge increases very rapidly. For these reasons, it is easy for the valve to be open too wide and for too long, causing excessive and rapid discharge. As a consequence, the suspension density rapidly falls below the set point. The valve is then forced to close to allow the suspension density to rise up back towards the set point. Thus, the system can often cycle between these two extremes of rapid slurry discharge leading to a rapid fall in the suspension density below the set point and reduced slurry discharge to bring the suspension density back to the set point. This cycling also makes it difficult to accurately target low set point densities near the suspension density of the feed.

The problem described above is acute for relatively small vessel cross-sections. In this case, the size of the valve must be large compared to the size of the vessel in order to allow the free passage of the coarser particles through the valve. Failure to do so will result in blockage and hence failure of the valve. When the valve is fully open, this can lead to the entire separator emptying very quickly.

Full scale industrial separators tend to have a valve size much smaller than the tank or vessel cross-section. Although relatively small, the valves are much larger than the coarsest particles, so bridging is not necessarily a problem. Nevertheless, these large vessels can also suffer from the problems described above, forcing the suspension in the zone above the valve to discharge too quickly with undesirable results. Rather, an orderly movement of material towards the underflow is essential in order to maximize the separation efficiency.

SUMMARY OF THE INVENTION

It is an object of the present invention to overcome or ameliorate at least one of the disadvantages of the prior art, or to provide a useful alternative.

To this end, a first aspect of the invention provides an apparatus for removing an underflow stream from a separator, said separator having a discharge outlet for discharging said underflow stream, said apparatus comprising:

a source of pressurised fluid;

a first conduit for fluidly connecting said pressurised fluid source to said discharge outlet such that said pressurised fluid is directed to impede the flow of said underflow stream in said first conduit, thereby creating a fluidisation zone, and a second conduit fluidly connected to said first conduit so that material from said fluidisation zone flows into said second conduit for removal from said apparatus, wherein the first conduit has a control valve for controlling the flow of said underflow stream, the control valve being adjacent to the discharge outlet.

Preferably, said pressurised fluid is directed as a counterflow to said flow of said underflow stream.

Preferably, said first conduit is substantially vertical relative to the apparatus. In one embodiment, said first conduit comprises a tube.

Preferably, said second conduit is inclined relative to said first conduit. More preferably, said material flows upwardly in said second conduit.

Alternatively, said second conduit is substantially orthogonal relative to said first conduit. In one embodiment, said second conduit is substantially horizontal.

Preferably, said second conduit comprises a side or branch conduit of said first conduit. In one embodiment, said second conduit comprises a tube.

Preferably, a pump is operatively associated with said second conduit to draw material from the fluidisation zone into said second conduit. In one embodiment, said pump is a peristaltic pump.

Preferably, said second conduit comprises an outlet, said second conduit being arranged such that said second conduit outlet is at a level lower than the level of liquid in said separator to create a positive head difference.

Preferably, said first conduit comprises an outlet for removing coarse particles.

Preferably, said pressurised fluid comprises water.

Preferably, said separator is a reflux classifier or teetered bed separator.

A second aspect of the invention provides a separator, comprising a tank with a discharge outlet for an underflow stream and an apparatus of the first aspect of the invention, wherein said first conduit is connected to said discharge outlet of said separator.

The separator preferably has the preferred features of the first aspect of the invention stated above, where applicable.

A third aspect of the invention provides a method for removing an underflow stream from a separator, said separator having a discharge outlet for discharging said underflow stream, said method comprising the steps of:

fluidly connecting a source of pressurised fluid to said discharge outlet;

controlling the flow of underflow stream adjacent to the discharge outlet;

directing said pressurised fluid to impede the flow of said underflow stream in a first conduit, thereby creating a fluidisation zone, and fluidly connecting a second conduit to said first conduit so that material from said fluidisation zone flows into said second conduit for removal.

Preferably, said directing step comprises directing said pressurised fluid as a counter-flow to said flow of said underflow stream.

Preferably, said pressurised fluid is directed to flow upwardly in said first conduit. More preferably, said method comprises arranging said first conduit substantially vertical to facilitate said upward flow of said pressurised fluid.

Preferably, said method comprises inclining said second conduit relative to said first conduit. More preferably, said material flows upwardly in said second conduit.

Alternatively, said method comprises arranging said second conduit substantially orthogonal to said first conduit.

Preferably, said method comprises drawing said material from said fluidisation zone into said second conduit. More preferably, said drawing step comprising pumping said material into said second conduit.

Preferably, said second conduit comprises an outlet, said method further comprising arranging said second conduit so that said second conduit outlet is at a level lower than the level of liquid in said separator to create a positive head difference.

Preferably, said method comprises removing coarse particles from said first conduit.

The method also preferably has the preferred features of the first aspect of the invention stated above, where applicable.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Furthermore, as used herein and unless otherwise specified, the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

BRIEF DESCRIPTION OF THE DRAWINGS

Preferred embodiments of the invention will now be described, by way of example only, with reference to the accompanying drawings in which.

PREFERRED EMBODIMENTS OF THE INVENTION

The present invention will now be described with reference to the following examples which should be considered in all respects as illustrative and non-restrictive.

Figure 1:
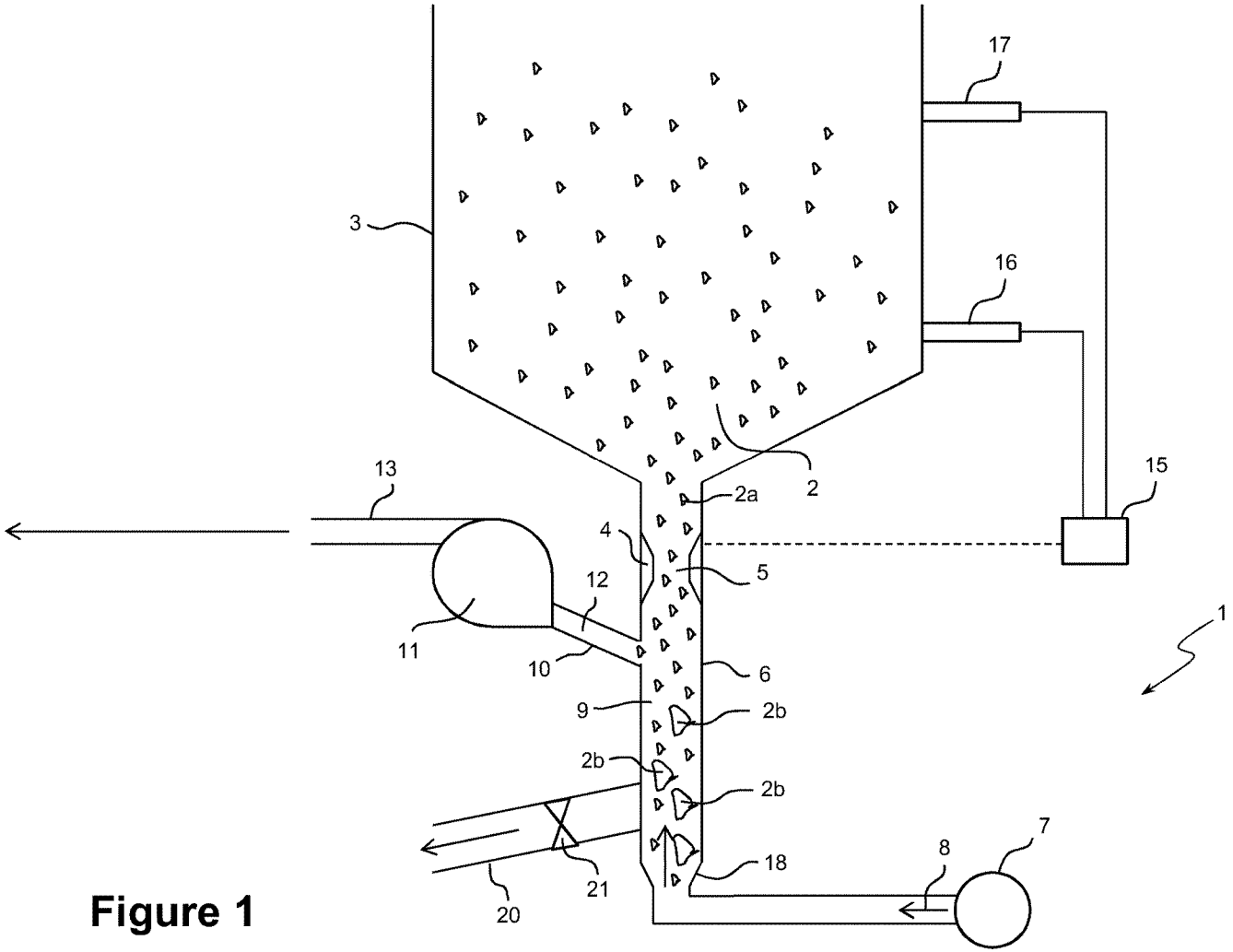
FIG. 1 is a schematic side view of an apparatus according to one embodiment of the invention.

FIG. 1 shows an apparatus 1 for removing an underflow stream 2 in the form of a slurry comprising fine particles 2*a* and coarse particles 2*b* from a separator 3 according to one embodiment of the invention. The separator 3 is either a reflux classifier or a teetered bed separator.

The underflow stream 2 passes through a control valve 4 and valve opening 5 of the separator 3 directly towards a first conduit 6. In this embodiment, the first conduit 6 is a substantially vertical fluidisation tube. In other embodiments, the first conduit can be inclined.

A source 7 of pressurised fluid 8 is fluidly connected to the fluidisation tube 6 so as to introduce a flow of the pressurised fluid 8 into the tube. This flow is set at a specific rate, ideally independent of underflow discharge. In this embodiment, the pressurised fluid is water. However, in other embodiments the pressurised fluid is a chemically inert liquid or gas.

The flow of pressurised fluid 8 impedes the flow of the underflow stream 2, creating a fluidisation zone 9 within the fluidisation tube 6. This flow creates the fluidisation effect. Due to the vertical orientation of the fluidisation tube 6, the flow of pressurised fluid 8 is a counter-flow to the flow of the underflow stream 2. It will be appreciated that in other embodiments, the flow of pressurised fluid 8 need only be sufficient to impede the normal progress of the underflow stream 2 in the first conduit 6 and thus need not be a directly opposing flow.

The flow rate of the pressurised fluid 8 to the fluidisation tube 6 is controlled either by a pump (not shown) associated with the pressurised fluid source 7 or from a mains pressure supply (not shown). A valve and flow meter or similar device (not shown) is used to set the rate of water supply. In this embodiment, the fluidisation rate is set relatively low to sufficiently fluidise the underflow stream 2 and create the fluidisation zone 9 without causing a back flow of fluidised material rising up from the fluidisation zone 9 through the valve opening 5 and into the separator 3. In practice, backflow should not happen because the flow via the pump will always be equal to or greater than the fluidization flow. The two will be equal when the valve is closed.

A second conduit in the form of an inclined tube 10 is connected to the fluidisation tube 6. In other embodiments, the second conduit need not be inclined and may instead be arranged to be substantially horizontal. However, in practice it is generally preferred that the second conduit is inclined to hinder over-sized particles from flowing up and potentially blocking the second conduit.

In this embodiment, the inclined tube 10 is operatively connected to a peristaltic pump 11, which draws material 12 from the fluidisation zone 9. If the control valve 4 below the separator 3 is closed then the pump 11 produces a suction pressure that at a minimum pumps the water 8 out of the fluidisation tube 6 and into the inclined tube 10. It will be appreciated that in other embodiments, different types of pumps can be used, such as negative pressure pumps, positive displacement pumps, centrifugal pumps and the like.

When the control valve 4 is opened the slurry 2 is free to flow downwards towards the fluidisation tube 6. Under these circumstances, however, the pressure difference across the control valve 4 is much lower due to the action of the pump 11 and the upward flow of the fluidisation water 8 in the fluidisation tube 6. Thus, the underflow stream 2 in effect experiences a buffer. Some particles and fluid will flow downwards into the fluidisation zone 9 while other particles will be drawn up the slight incline of the inclined tube 10 and into the peristaltic pump 11 and through a discharge conduit 13. The flow rate of the pump 11 is set so as to be larger than the fluidisation rate. Thus, whatever the setting on the control valve 4, the maximum discharge rate of the slurry 2 is limited to the setting on the peristaltic pump 11, less the fluidisation rate in the vertical fluidisation tube 6. In other words, the maximum discharge rate is determined by the pumping rate in the second conduit less than the rate of flow of the pressurised fluid. Thus there is an upper limit on the discharge rate of the slurry 2 even when the control valve 4 is fully open.

In practice there needs to be the potential for the pump or head difference to generate a flow larger than that delivered via the pressurised fluid. The pressurised fluid is set at specific flow rate, while the discharge rate (as set by the pump or head difference) is larger. This means that underflow is drawn downwards from the separator. The controller can choose to allow this underflow or a portion of this flow or no flow by gradually closing to reduce the underflow. The pressurised fluid impedes the underflow, meaning that the underflow valve can be opened up much more than would normally be possible. This creates the steady underflow that is desired.

Although the peristaltic pump 11 is operated at a relatively high flow rate, the slurry discharge rate from the separator 3 can be varied as required over a very broad range. As a consequence, the control valve 4 is free to target a suspension density by closing or opening as required in response to a PID controller 15 associated with pressure transducers 16, 17 arranged at different heights of the separator 3.

In addition, the slurry 2 that discharges from the separator 3 combines with the fluidisation water 8 to produce a more dilute underflow. This dilution is generally not a problem because the underflow can, under these conditions, be transported around the plant. Dewatering is easily achieved because the underflow from the separator 3 is typically free of slimes.

The technical advantages as demonstrated in this embodiment are significant. The control valve 4 is free to open to any percentage and is more directly responsive to changes in the suspension density measured by the transducers 16, 17. Indeed, the control valve 4 will tend to become far more open than it would otherwise be without the apparatus 1, allowing the control valve 4 to function in the linear region rather than non-linearly as in the prior art. Coarse particles 2 can discharge freely with no bridging and drop past the fluidisation zone 9 towards the bottom or base 18 of the fluidisation tube 6. Hence, the system does not cycle between extremes as there is never any over-reaction from the PID controller 15, meaning that the controller seeks out the correct discharge rate within more suitable limits. To produce these same limits in a conventional system the valve 4 would be forced to be open to a marginal level, resulting in a smaller opening 5 that is prone to constant bridging by particles larger than the opening and leading to the filtration of water through the gaps between the particles.

The fluidisation tube 6 can be prone to being filled up with particles in the slurry 2. However, most of these particles will simply fluidise, meaning that excess particles will flow directly to the peristaltic pump 11. Accordingly, a steady state is quickly reached. Only the over-sized coarse particles 2*b*, which in principle should not be present, would sink towards the base 18 of the fluidisation tube 6. To prevent this area from becoming clogged with such particles, a removal conduit 20 and an associated valve 21 are connected to the fluidisation tube 6 to discharge these particles. This discharge of coarse particles 2*b* could be done manually or automatically. Alternatively, the tube 6 could be designed to have a greater capacity to accommodate the coarse particles 2*b*. For large industrial units it is unlikely the accumulation of over-sized coarse particles would be an issue. For smaller units, however, it is necessary to keep these coarse particles 2*b* from the peristaltic pump 11 and discharge conduit 13.

There will be times when the required pumping rate is higher than the level set for the peristaltic pump 11. In this case, the control valve 4 would be fully open (i.e. at 100%) while the measured bed density would always remain above the set point. In this situation the peristaltic pumping rate simply needs to be increased. Once this is done, full control can resume. It will be appreciated to those skilled in the art that a hierarchical form of control can be used in this situation. Thus, where it is observed or even anticipated that the pumping rate for the peristaltic pump 11 is insufficient, then its pumping rate can be increased before the situation can arise. The level of additional control should be minimal. Once the peristaltic pumping rate is set, it should cover a very large range of discharge rates for the slurry 2. Of course, if the slurry 2 appears far too dilute it is reasonable to reduce the discharge rate. The fluidisation rate supplied to the fluidisation tube 6 can also be monitored. Either way, once set, the apparatus 1 provides ample flexibility and little need for manual intervention unless desired.

Figure 2:
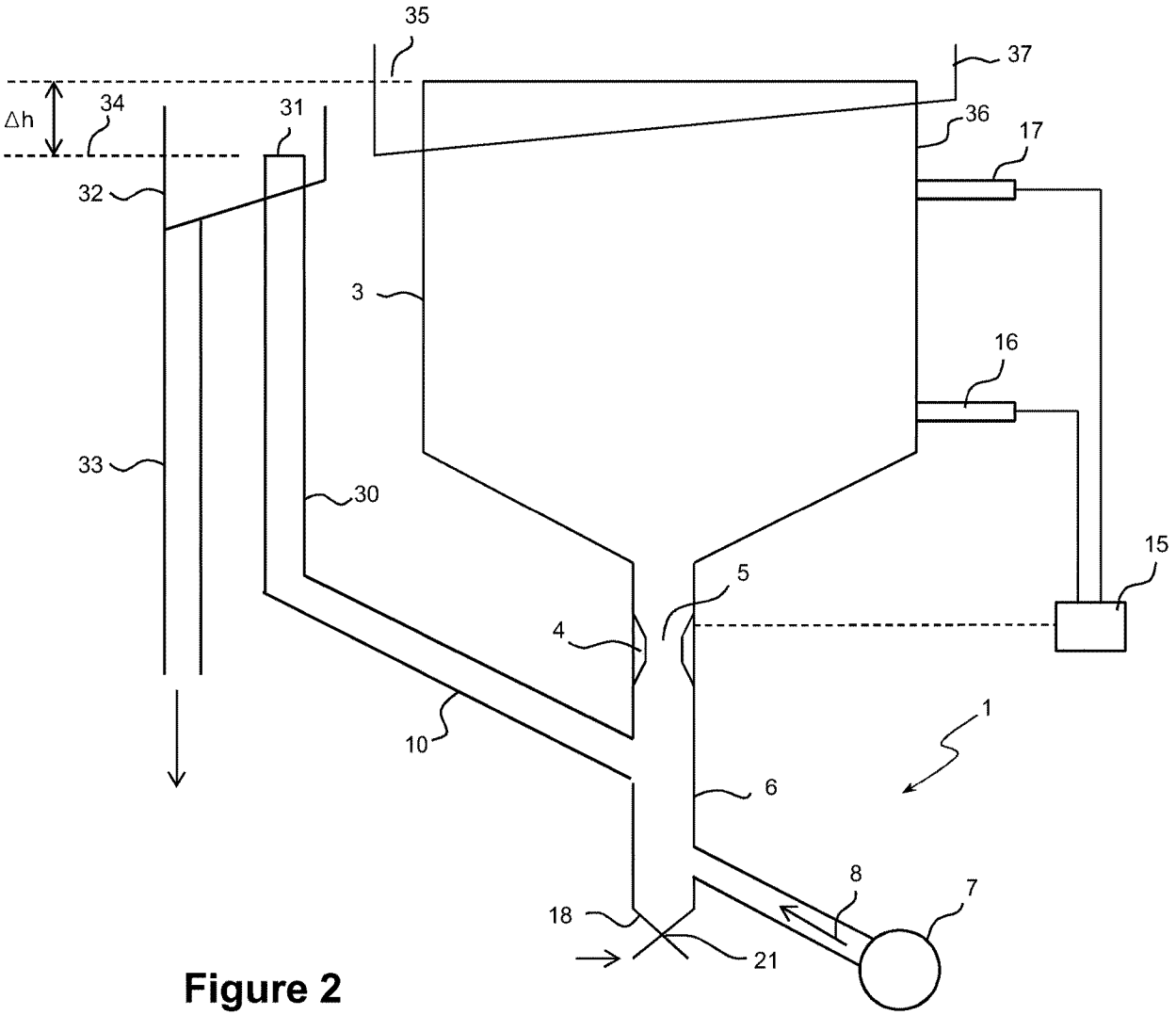
FIG. 2 is a schematic side view of an apparatus according to another embodiment of the invention.

Referring to FIG. 2, where corresponding features have been given the same reference numerals, another embodiment of the invention provides a more simple design by utilising a reduced head level to control the maximum underflow rate that can be produced. In this embodiment, the arrangement of the fluidisation tube 6, the pressurised fluid source 7 and the inclined tube 10 remains the same. However, there is no pump associated with the inclined tube 10. Instead, the inclined underflow tube 10 is fluidly connected to another conduit in the form of a vertical transport tube 30 that conveys the underflow stream 2 to a high elevation relative to the fluidisation tube 6 and the inclined tube 10, where it exits from an outlet 31 into a launder 32 for removal through a discharge conduit 33. At this high elevation there is a positive head difference $\Delta h$ between the level 34 of the underflow stream 2 exiting the outlet 31 and the level 35 of the liquid in the main vessel 36 of the separator, which is below a recovery launder 37. Thus, when the control valve 4 is fully opened, there is a strong discharge or flow of slurry 2, but modest compared to the discharge rate if the positive head difference $\Delta h$ was much larger.

The transport tube 30 conveys both the fluidised water 8 and fine particles in an upwards direction relative to the fluidisation tube 6. However, there will be "slip"; that is, the particles will rise up through the tube 30 at a velocity that is less than that of the fluid due to the normal gravitational settling of the particles, thus resulting in faster settling particles settling downwards. For this reason, some fluidisation water 8 is needed in the transport tube 30, especially when the net underflow rate through the control valve 4 is relatively low. Thus, the fluidisation rate needs to be set at a sufficient rate to ensure that the particles that need to be removed upwards in the inclined tube 10 and transport tube 30 are conveyed by the fluidisation water 8.

It will be appreciated that in other embodiments, the transport tube 30 needs not be substantially vertical but can be inclined at a different angle of inclination to the inclined tube 10. In a further embodiment, the transport tube 30 is an extension of the inclined tube 10 (i.e. effectively a single tube) that leads to the high elevation outlet 31.

A primary advantage of this embodiment is that there is no need for a pump and hence there are no moving parts. As a consequence, this embodiment is simpler in design and cheaper to manufacture. When the control valve 4 is closed, the fluidisation water 8 dominates the system, and flows upward to the overflow point at the outlet 31. As the control valve 4 starts to open, the fixed fluidization combines with the underflow to produce more flow and the fluidisation does not change. The fluidisation in the fluidisation tube 6 ensures there is sufficient velocity to convey all of the particles that need to be conveyed upwardly in the inclined tube 10 and the transport tube 30.

In this embodiment, the underflow control valve 4 in general needs to be more open to deliver a given underflow rate. With this increased size of the opening 5 there is little or no tendency for coarse particles to bridge the opening. This means that the underflow control is much more consistent, and does not build to excessive levels. As a result, the underflow stream 2 is free to move downwards. There is also no or little prospect for blockages arising from coarse particles 2*b*, as they tend to accumulate as a packed bed at the base 18 of the fluidisation tube 6. These oversize particles tend to occupy a tiny volume, and so can be discharged intermittently via the valve 21 with little or no impact on the overall process. In this embodiment a solenoid valve adapted to open at a set frequency may be employed. The inclined underflow tube 10 is relatively small in diameter, so a modest fluidisation rate ensures that the underflow stream 2 can be conveyed upwards towards the transport tube 30.

Overall, there is strong and highly favourable synergy between the control valve 4 and the pressure head difference $\Delta h$ created by this embodiment. It is contemplated that this pressure head generated by the pressure head difference $\Delta h$ is sufficient to allow for the full discharge of the entire feed into the main vessel 36. However, the feed rate could be set lower than this maximum level. Once set for a given operation, it should not need to be changed.

It will further be appreciated that any of the features in the preferred embodiments of the invention can be combined together and are not necessarily applied in isolation from each other. For example, the tube 10 can be substantially horizontal in either embodiment of the invention. Similarly, the conduits need not be cylindrical tubes but can have other polygonal cross-sections, such as an oval, rectangular, square or an irregular polygonal cross-section, where required. Similar combinations of two or more features from the above described embodiments or preferred forms of the invention can be readily made by one skilled in the art.

It should be noted that the concept of the present invention may be applied to rotating separation devices which rely upon high G forces or centrifugal forces to create separation. Typically in rotating separation devices the openings for underflow discharge are even more constrained, as in enhanced gravity separation. However, the same approach can be used, with the orientation being against the G force in the same way that the illustrated embodiments are configured to act against the direction of gravity.

By providing a pressurised fluid to impede or buffer the underflow stream exiting a separator, the invention confers the advantages of solving or minimising the long standing problem associated with the control of the underflow discharge from slurry systems. The embodiments of the invention overcome the difficulties associated with a large pressure head (created by the underflow stream) adjacent to the control valve, the bridging of the small valve openings by coarse particles and the strong non-linearity of the discharge relative to the control valve position. As a consequence, the control problem that results in cycling of the system is overcome to permit very precise control to be achieved. Moreover, the PID controller 15 can respond more accurately and quickly to the signals from the pressure transducers 16, 17 instead of potential blockages of the valve opening 5 or sudden changes in discharge rates of the underflow stream. Moreover, the invention can be readily implemented to existing separators without much difficulty. In all these respects, the invention represents a practical and commercially significant improvement over the prior art.

Although the invention has been described with reference to specific examples, it will be appreciated by those skilled in the art that the invention may be embodied in many other forms.

The invention claimed is:

1. An apparatus for removing an underflow stream from a separator, said separator having a discharge outlet for discharging said underflow stream, said apparatus comprising:

a source of pressurised fluid;

a first conduit for fluidly connecting said pressurised fluid source to said discharge outlet such that said pressurised fluid is directed to impede the flow of said underflow stream in said first conduit, thereby creating a fluidisation zone, and a second conduit fluidly connected to said first conduit so that material from said fluidisation zone flows into said second conduit for removal from said apparatus, wherein the first conduit has a control valve for controlling the flow of said underflow stream, the control valve being located at the discharge outlet and operatively connected to a PID controller such that the control valve may be opened at any percentage in response to the PID controller.

2. The apparatus of claim 1, wherein said pressurised fluid is directed as a counter-flow to said flow of said underflow stream.

3. The apparatus of claim 1, wherein said first conduit is substantially vertical relative to the apparatus.

4. The apparatus of claim 1, wherein said second conduit is inclined relative to said first conduit.

5. The apparatus of claim 4, wherein said second conduit comprises a side or branch conduit of said first conduit.

6. The apparatus of claim 1, wherein a pump is operatively associated with said second conduit to draw said material from the fluidisation zone into said second conduit.

7. The apparatus of claim 1, wherein said second conduit comprises an outlet, said second conduit being arranged such that said second conduit outlet is at a level lower than the level of liquid in said separator to create a positive head difference.

8. A separator, comprising a tank with a discharge outlet for an underflow stream and the apparatus of claim 1, wherein said first conduit is connected to said discharge outlet of said separator.

9. A method for removing an underflow stream from a separator, said separator having a discharge outlet for discharging said underflow stream, said method comprising the steps of:

fluidly connecting a source of pressurised fluid to said discharge outlet;

controlling the flow of said underflow stream at the discharge outlet with a control valve is operatively connected to a PID controller such that the control valve may be opened at any percentage in response to the PID controller;

directing said pressurised fluid to impede the flow of said underflow stream in a first conduit, thereby creating a fluidisation zone, and fluidly connecting a second conduit to said first conduit so that material from said fluidisation zone flows into said second conduit for removal.

10. The method of claim 9, wherein said directing step comprises directing said pressurised fluid as a counter-flow to said flow of said underflow stream.

11. The method of claim 9, wherein said pressurised fluid is directed to flow upwardly in said first conduit.

12. The method of claim 9, comprising drawing said material from said fluidisation zone into said second conduit.

13. The method of claim 9, wherein said second conduit comprises an outlet, said method further comprising arranging said second conduit so that said second conduit outlet is at a level lower than the level of liquid in said separator to create a positive head difference.

14. The apparatus of claim 1, wherein the control valve is located above the second conduit.

15. The apparatus of claim 1, wherein the control valve is downstream of the second conduit relative to the pressurised fluid flow from the pressurised fluid source.

16. The apparatus of claim 1, wherein the control valve is upstream of the second conduit relative to the underflow stream exiting the discharge outlet.

17. The method of claim 9, further including locating the control valve above the second conduit.

18. The method of claim 9, further including locating the control valve downstream of the second conduit relative to the pressurised fluid flow from the pressurised fluid source.

19. The method of claim 9, further including locating the control valve upstream of the second conduit relative to the underflow stream exiting the discharge outlet.

20. The apparatus of claim 1, wherein the PID controller detects the suspension density of the material in the separator.

21. The apparatus of claim 20, wherein one or more pressure sensors are operatively connected to the PID controller to detect the suspension density of the material in the separator.

22. The method of claim 9, further comprising detecting the suspension density of the material in the separator with the PID controller and operating the control valve in response to the detecting step.

* * * * *